US009182722B2

(12) United States Patent
Ikuta et al.

(10) Patent No.: US 9,182,722 B2
(45) Date of Patent: Nov. 10, 2015

(54) IMAGE FORMING SYSTEM AND CONTROL METHOD FOR THE SAME

(71) Applicant: KONICA MINOLTA, INC., Chiyoda-ku, Tokyo (JP)

(72) Inventors: Katsuyuki Ikuta, Hamamatsu (JP); Katsunori Takahashi, Hachioji (JP); Kenichi Hayashi, Hino (JP); Kazutoshi Yoshimura, Toyokawa (JP); Tatsuhiro Noutomi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/475,186

(22) Filed: Sep. 2, 2014

(65) Prior Publication Data

US 2015/0063848 A1 Mar. 5, 2015

(30) Foreign Application Priority Data

Sep. 3, 2013 (JP) ..... 2013-182242

(51) Int. Cl.
*G03G 15/00* (2006.01)
*G03G 21/14* (2006.01)
(Continued)

(52) U.S. Cl.
CPC ..... *G03G 15/6529* (2013.01); *B65H 5/062* (2013.01); *B65H 7/20* (2013.01); *G03G 15/6564* (2013.01); *G03G 21/14* (2013.01); *G03G 21/1604* (2013.01); *B65H 2301/4474* (2013.01); *B65H 2402/10* (2013.01); *B65H 2511/414* (2013.01); *B65H 2511/417* (2013.01); *B65H 2513/512* (2013.01); *B65H 2801/06* (2013.01);
(Continued)

(58) Field of Classification Search
CPC ..... G03G 15/2085; G03G 15/6529
See application file for complete search history.

(56) References Cited

U.S. PATENT DOCUMENTS 6,608,988 B2 * 8/2003 Conrow ..... 399/364
2011/0299889 A1 * 12/2011 Kerxhalli et al. ..... 399/160
(Continued)

FOREIGN PATENT DOCUMENTS

JP 2012091323 A 5/2012
JP 2012091357 A 5/2012
JP 2012108273 A 6/2012

OTHER PUBLICATIONS

Japanese Office Action (and English translation thereof) dated Aug. 18, 2015 (dispatch date), issued in counterpart Japanese Application No. 2013-182242.

*Primary Examiner* — Sandra Brase
(74) *Attorney, Agent, or Firm* — Holtz, Holtz, Goodman & Chick PC

(57) ABSTRACT

A serial tandem image forming system is described which is capable of inhibiting both the degradation of image quality and the reduction of the productivity. This system consists mainly of the control units of upstream and downstream apparatuses. When a preceding sheet differs from the subsequent sheet in sheet type, a control unit for controlling the image forming system has the subsequent sheet stand by at a paper stop roller of the upstream apparatus, and performs the operation of switching the operating states of the upstream and downstream apparatuses in accordance with the sheet type of the subsequent sheet. Also, the control unit predicts the timing of finishing the switching of the operating state, and then re-starts the conveyance of the subsequent sheet, in advance of finishing the switching of the operating state, by controlling the paper stop roller on the basis of the predicted finishing timing.

20 Claims, 4 Drawing Sheets

(51) Int. Cl.

| | |
|---|---|
| ***G03G 21/16*** | (2006.01) |
| ***B65H 5/06*** | (2006.01) |
| ***B65H 7/20*** | (2006.01) |

(52) U.S. Cl.
CPC ..... *G03G 15/70* (2013.01); *G03G 2215/00021* (2013.01)

(56) References Cited

U.S. PATENT DOCUMENTS

| | | | |
|---|---|---|---|
| 2012/0099151 | A1 | 4/2012 | Kurihara |
| 2012/0099152 | A1 | 4/2012 | Kamata |
| 2012/0120422 | A1 | 5/2012 | Hitaka |

* cited by examiner

IMAGE FORMING SYSTEM AND CONTROL METHOD FOR THE SAME

CROSS-REFERENCE TO RELATED APPLICATIONS

The present application claims priority under 35 U.S.C. §119 to Japanese Patent Application No. 2013-182242, filed Sep. 3, 2013. The contents of this application are herein incorporated by reference in their entirety.

BACKGROUND OF THE INVENTION

1. Field of Invention

The present invention relates to a serial tandem image forming system and a method of controlling the same.

2. Description of Related Art

In recent years, a serial tandem image forming system is known which includes a plurality of image forming apparatuses connected in series. For example, in the case of an image forming system consisting of two serially connected image forming apparatuses, the upstream side image forming apparatus (upstream apparatus) forms an image on one side of a sheet, and then the downstream side image forming apparatus (downstream apparatus) forms an image on the other side of the sheet. This improves the productivity in comparison with double-side printing performed by an individual image forming apparatus (for example, refer to Japanese Patent Published Application No. 2012-91357).

The image forming apparatus may for example be an electrophotographic image forming unit. Such an electrophotographic image forming unit performs a series of processes which include forming a toner image on an image bearing member, transferring the image to a sheet, and then fixing the image to the sheet. In this case, since there may be different operating states suitable for processing different sheet types respectively, the operating state of the image forming apparatus is switched in accordance with the sheet type, for example, between a cardboard and a thin sheet. The operating state can be designated by a fixing temperature, a nipping pressure at a transfer unit and/or a fixing unit, and so forth.

A print job may include not only a process of sequentially printing images on a plurality of the same type sheets, but also processes of printing images on a plurality of different type sheets which are switched during printing. In the former case, the print job can be performed with no need for switching the operating state of the image forming apparatus. On the other hand, in the latter case, the print job is performed by switching the operating state of the image forming apparatus with a timing when switching the sheet type between a preceding sheet and the subsequent sheet following the preceding sheet. A sheet cannot be conveyed while switching the operating state, and therefore the subsequent sheet is temporarily stopped at a registration unit from which each sheet is sent out to an image formation process (a transfer process with a transfer unit and a fixing process with a fixing unit). The subsequent sheet is conveyed again after finishing the switching of the operating state.

Namely, in the case of the serial tandem image forming system, the subsequent sheet is standing by at the registration unit of an upstream apparatus until the switching of the operating state is finished. In this case, since the sheet conveyance distance of the serial tandem image forming system is longer than that of a single image forming apparatus, the productivity may be reduced due to the distance between the subsequent sheet and the preceding sheet which becomes wider when halting and resuming the conveyance of the subsequent sheet.

It is conceived to have the subsequent sheet stand by after further conveying the subsequent sheet to an advanced position in the downstream side of the registration unit in the upstream apparatus to shorten the conveyance distance after the resumption of sheet conveyance. However, in this case, the subsequent sheet may stop in the middle of the image formation process, for example, in a transfer unit or a fixing unit. The image quality may thereby be degraded depending upon the stopping position. Particularly, while an image is to be formed also by the downstream apparatus on the same sheet, it is undesirable that such a situation occurs in the upstream apparatus.

The present invention has been made in order to solve the problems as described above. It is an object of the present invention therefore to inhibit both the reduction of the degradation of image quality and the reduction of the productivity.

SUMMARY OF THE INVENTION

To achieve at least one of the abovementioned objects, a serial tandem image forming system reflecting one aspect of the present invention comprises: a first image forming apparatus configured to form an image on a sheet; a second image forming apparatus connected to the first image forming apparatus in series and configured to form an image on the sheet which is supplied from the first image forming apparatus; and a controller configured to control the first image forming apparatus and the second image forming apparatus respectively. Each of the first image forming apparatus and the second image forming apparatus of this image forming system is provided with a registration unit which sends out a sheet to an image formation process. Also, when a preceding sheet and a subsequent sheet coming just after the preceding sheet differ in sheet type, the controller performs an operation of switching an operating states of the first image forming apparatus and the second image forming apparatus in accordance with the sheet type of the subsequent sheet while having the subsequent sheet stand by at the registration unit. Furthermore, the controller predicts the finishing timing with which the switching of the operating state is finished, and then re-starts the conveyance of the subsequent sheet, in advance of finishing the switching of the operating state, by controlling the registration unit on the basis of the predicted finishing timing.

In accordance with the present invention as described above, it is preferred that when the subsequent sheet is supplied to the second image forming apparatus after re-starting the conveyance, the controller determines whether or not the switching of the operating state of the second image forming apparatus has been finished, and processes the subsequent sheet as a jammed sheet if it is determined that the switching of the operating state of the second image forming apparatus has not been finished yet.

Also, it is preferred that when the subsequent sheet is processed as a jam sheet, the controller adds a predetermined margin to the predicted finishing timing for a sheet which comes after the subsequent sheet.

Furthermore, it is preferred that when a sheet reaches the registration unit of the second image forming apparatus, the controller determines whether or not the switching of the operating state has been finished.

Furthermore, it is preferred that the first image forming apparatus and the second image forming apparatus are capable of switching, as the operating state, the fixing temperature and the pressure contact condition of the nip portion. In this case, the controller compares a stabilization time, which is required to stabilize the fixing temperature to a target temperature after switching, with a switching time of the pressure contact condition of the nip portion to a target condition after switching, and predicts the finishing timing on the basis of the later of the stabilization time and the switching time.

Furthermore, it is preferred that the controller predicts the finishing timing on the basis of the latest time of the stabilization and switching times of the first image forming apparatus and the second image forming apparatus.

Furthermore, it is preferred that the controller sets up the stabilization time on the basis of the target temperatures before and after switching and a predetermined temperature profile.

Furthermore, it is preferred that the controller sets up the switching time by measuring beforehand the time required to switch the pressure contact condition.

DETAILED DESCRIPTION OF THE PREFERRED EMBODIMENT

Figure 1:
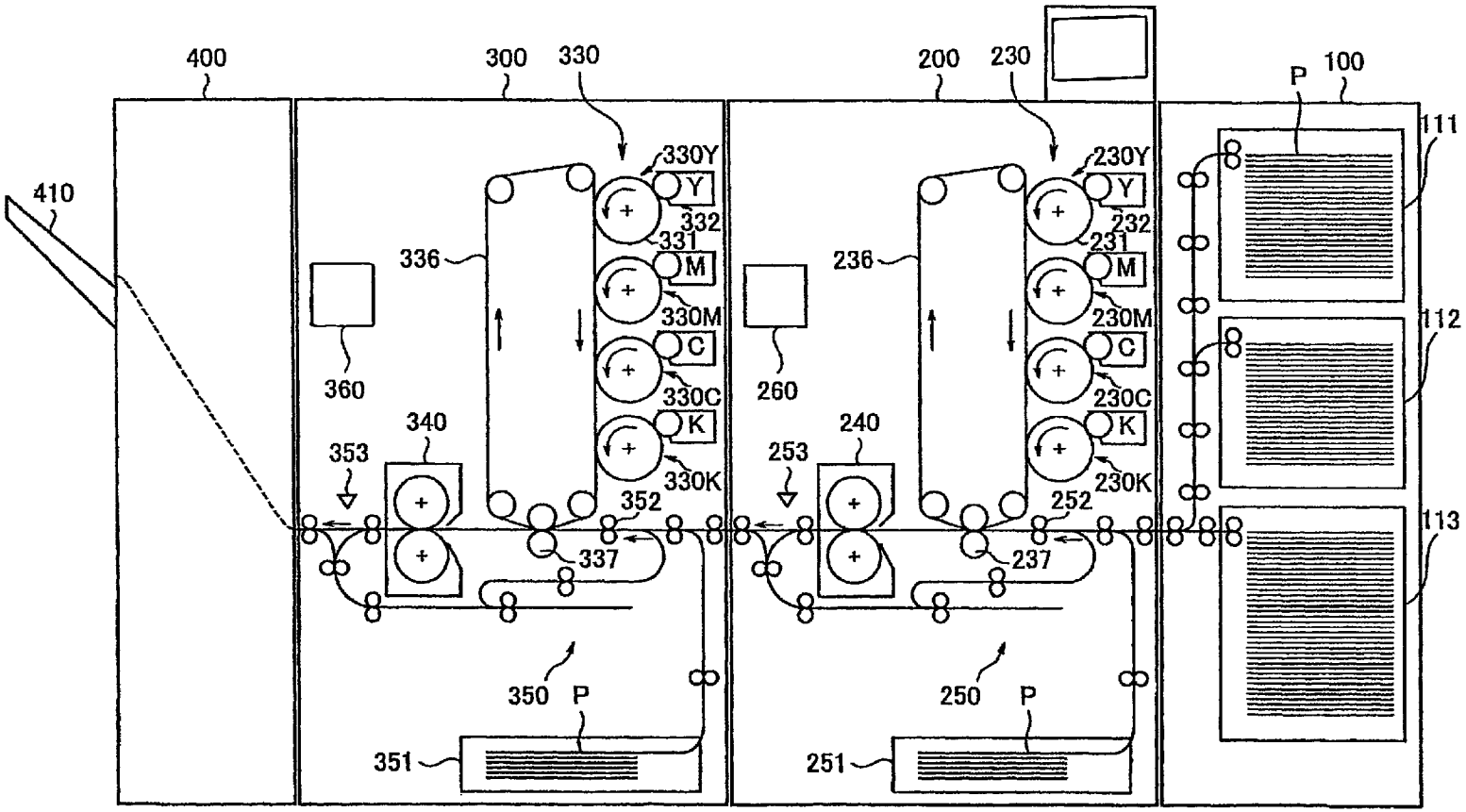
FIG. 1 is an explanatory view for schematically showing the structure of an image forming system in accordance with an embodiment of the present invention.

FIG. 1 is an explanatory view for schematically showing the overall configuration of an image forming system in accordance with an embodiment of the present invention. The image forming system is provided with a large volume paper feed unit 100, an upstream apparatus 200, a downstream apparatus 300, and a discharge device 400. The upstream apparatus 200 and downstream apparatus 300 are electrophotographic image forming apparatuses, for example copying machines, which have the same configuration and connected in series to form the image forming system which is called a tandem type. In accordance with such an image forming system, a double-side printing job can be performed at a high speed by forming an image on the front side of a sheet P with the upstream apparatus 200 and then forming an image on the back side of the sheet with the downstream apparatus 300.

The large volume paper feed unit 100 is a device for accumulating and storing a large volume of sheets P and supplying the upstream apparatus 200 and the downstream apparatus 300 with the sheets P. Also, the large volume paper feed unit 100 is connected to the upstream side (as viewed in the direction of conveying sheets P) of the upstream apparatus 200 in series. The large volume paper feed apparatus 100 consists of a plurality of paper feed trays, for example, three paper feed trays 111 to 113 capable of storing sheets P respectively. The large volume paper feed apparatus 100 conveys sheets P suitable for a current job, one by one, from a corresponding one of the paper feed trays 111 to 113 to the upstream apparatus 200.

The upstream apparatus 200 is a first image forming apparatus for forming images on sheets P, and connected to the downstream side of the large volume paper feed unit 100. This upstream apparatus 200 is configured to receive sheets P discharged from the large volume paper feed unit 100, and capable of forming images on sheets P discharged from the large volume paper feed unit 100 or on sheets P stored in the upstream apparatus 200 itself. The upstream apparatus 200 consists mainly of an image forming unit 230, a transfer unit 237, a fixing unit 240, a conveyance unit 250 and a control unit 260.

The image forming unit 230 includes a plurality of photoreceptor drums vertically arranged in contact with one intermediate transfer belt to transfer full-color images to sheets P. Specifically describing, the image forming unit 230 consists of four image forming units 230Y, 230M, 230C and 230K corresponding to yellow, magenta, cyan and black. While the image forming unit 230Y corresponding to yellow will be explained below, the image forming units 230M through 230K corresponding to the other colors have the same structure as the image forming unit 230Y.

The image forming unit 230Y includes a photoreceptor drum 231 and a developing unit 232. The developing unit 232 consists, for example, mainly of a charging section, an exposure section and a developing section. The charging section uniformly charges the peripheral surface of the photoreceptor drum 231. The exposure section irradiates the photoreceptor drum 231 with a laser beam to form an electrostatic latent image on the surface of the photoreceptor drum 231. The developing section makes visible the latent image formed on the surface of the photoreceptor drum 231 with toner. By this process, an image (toner image) is formed on the photoreceptor drum 231. The image formed on the photoreceptor drum 231 is successively transferred to a predetermined location of the intermediate transfer belt 236.

The image consisting of respective color images transferred to the intermediate transfer belt 236 is transferred to a sheet P with a predetermined timing by a transfer roller 237. The transfer roller 237 and the intermediate transfer belt 236 are in contact with each other and urged against each other to form a nip portion (transfer nip portion) therebetween.

The conveyance unit 250 consists mainly of a paper feed tray 251, a number of conveyance rollers and guide members, and serves to convey sheets P. Sheets P stored in the paper feed tray 251 or received from the large volume paper feed unit 100 are conveyed by the conveyance rollers, and collides with the paper stop rollers 252, which are not rotated in a halting state. The misalignment of the sheet P can be corrected by this collision operation (skew correction). The paper stop roller 252 then resumes rotation with a predetermined timing to convey the sheet P, which is thereby conveyed to the transfer nip portion with a predetermined timing in synchronization with an image formed on the intermediate transfer belt 236. The paper stop roller 252 of the present embodiment serves as a registration unit from which each sheet P is sent out, after a pause, to an image formation process which includes a transfer process with a transfer unit (the transfer roller 237) and a fixing process with the fixing unit 240.

The sheet P with an image transferred thereto is conveyed to the fixing unit 240. The fixing unit 240 consists, for example, of a heat roller and a pressure roller. The pressure roller is located in contact with the heat roller under pressure to form a nip portion (fixing nip portion) therebetween. The heat roller incorporates a heat source (not shown in the figure) with which the heat roller is controlled to a predetermined temperature. When a sheet P is passed through the fixing nip portion during the conveyance of the sheet P, the image transferred to the sheet P is heated and pressed, and then fixed to the sheet P.

After the fixing process with the fixing unit 240, the sheet P is discharged out of the upstream apparatus 200 by a discharging roller. When a double-side printing job is performed in cooperation with the downstream apparatus 300 by reversing the front and back sides of the sheet P sent out from the fixing unit 240 and discharging the reversed sheet to the downstream apparatus 300, the sheet P is transferred to reversing rollers located below through a switch gate. The reversing rollers hold the tail end of the sheet P which is conveyed therebetween and then reverses the sheet P by sending back it to discharging rollers. By this process, the sheet P is discharged out of the upstream apparatus 200 after reversing the front and back sides compared to the time when the sheet P was passing between the fixing nip portion 240.

This upstream apparatus 200 is capable of not only forming an image on one side of a sheet P but also solely performing images on the opposite sides of a sheet P. In this case, the sheet P transferred from the fixing unit 240 after image formation on one side of the sheet P is conveyed to the reversing rollers located below by the switching gate. After holding the tail end of the sheet P which is conveyed, the reversing rollers reverses the conveyance direction of the sheet P to reverse the sides of the sheet, followed by directing the sheet P to a refeed conveying route. The sheet P directed to the refeed conveying route is then returned to the paper stop roller 252 again by the conveyance rollers.

The control unit 260 serves to control the image formation process with the upstream apparatus 200. The control unit 260 controls the respective units (the image forming unit 230, the fixing unit 240 and the conveyance unit 250) of the upstream apparatus 200 in accordance with a job designated by a user to perform a series of processes as described below. By this configuration, an image can be formed on the sheet P in accordance with the job.

(1) The charging section electrostatically charges the photoreceptor drum 231.

(2) The exposure section forms an electrostatic latent image on the photoreceptor drum 231.

(3) The developing section adheres toner to the electrostatic latent image.

(4) The image formed on the photoreceptor drum 231 is transferred to the sheet P.

(5) The transferred image is fixed to the sheet P by the fixing process.

The control unit 260 performs image formation on the basis of image data to perform the job. On the assumption that the image forming system is provided with an original reading unit which is not shown in the figure, the control unit 260 can acquire image data by reading originals through the original reading unit when a user designates a job through a manipulation unit or the like. Incidentally, the image data can be the data for example as received from a personal computer, another image forming apparatus or the like connected to the image forming apparatus together with the job data.

Incidentally, the upstream apparatus 200 can simply convey a sheet P through its inside space without forming an image to discharge the sheet P out of this apparatus to the downstream apparatus 300.

The downstream apparatus 300 is a second image forming apparatus for forming images on sheets P, and connected to the downstream side of the upstream apparatus 200 in series. This downstream apparatus 300 is configured to receive sheets P discharged from the upstream apparatus 200, and capable of forming images on sheets P discharged from the upstream apparatus 200 or on sheets P stored in the downstream apparatus 300 itself. The downstream apparatus 300 consists mainly of an image forming unit 330, a transfer unit 337, a fixing unit 340, a conveyance unit 350 and a control unit 360.

Meanwhile, the downstream apparatus 300 is an image forming apparatus having a similar architecture as the upstream apparatus 200, and the elements 330 to 360 of the downstream apparatus 300 are provided respectively corresponding to the elements 230 to 260 of the upstream apparatus 200. Like the upstream apparatus 200, the downstream apparatus 300 is capable of not only forming an image on one side of a sheet P but also solely performing images on the opposite sides of a sheet P, and also capable of simply conveying a sheet P through its inside space without forming an image to discharge the sheet P out of the apparatus.

The discharge unit 400 outputs sheets P discharged from the downstream apparatus 300 to the catch tray 410 on which the sheets P are stacked. Furthermore, this discharge unit 400 is capable of sorting sheets P in units of jobs, units of print copies, or in any arbitrary units by stacking the sheets P in different positions on the catch tray 410.

In the image forming apparatuses constructed as described above, the control unit 260 of the upstream apparatus 200 and the control unit 360 of the downstream apparatus 300 function also as a controller for integrally controlling the image forming system. Namely, each of the control units 260 and 360 can not only individually control own apparatus but also communicate with the other unit to perform necessary processes in cooperation for forming images from the upstream apparatus 200 to the downstream apparatus 300 and control the states of the large volume paper feed apparatus 100 and the discharge unit 400. For example, the control unit 260 of the upstream apparatus 200 switches the operating state of the upstream apparatus 200, and controls the conveyance of a sheet P through the upstream apparatus 200 to supply the sheet P to the downstream apparatus 300. On the other hand, the control unit 360 of the downstream apparatus 300 switches the operating state of the downstream apparatus 300, receives a sheet P from the upstream apparatus 200, and controls the conveyance of the sheet P through the downstream apparatus 300.

The control unit 260 of the upstream apparatus 200 can determines whether a sheet P is passed through the fixing unit 240 on the basis of the detection result of a sheet detection sensor 253. On the other hand, the control unit 360 of the downstream apparatus 300 can determines whether a sheet P is passed through the fixing unit 340 on the basis of the detection result of a sheet detection sensor 353.

Figure 2:
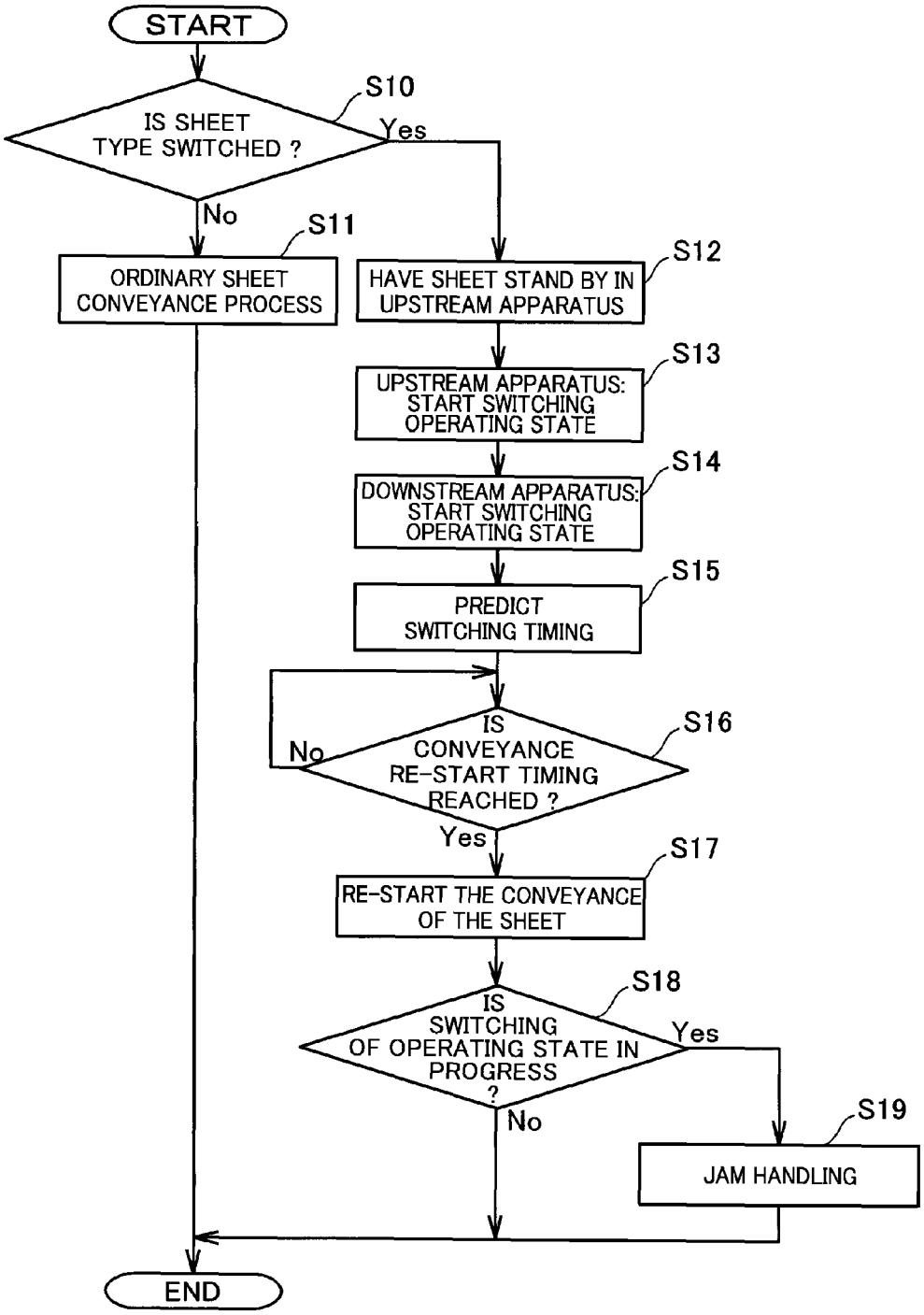
FIG. 2 is a flow chart showing the procedure of performing a series of steps for controlling the operation of the image forming system as shown in FIG. 1.

FIG. 2 is a flow chart showing the procedure of performing a series of steps for controlling the operation of the image forming system in accordance with the present embodiment. The procedure shown in this flow chart includes the steps for processing one sheet during execution of a job, and is repeated for each sheet when the job is performed with a plurality of sheets. In the following description, it is assumed that a subsequent sheet P is to be processed following a preceding sheet, and the flow chart shows an example of controlling the conveyance of the subsequent sheet P.

First, in step 10 (S10), the control unit 260 of the upstream apparatus 200 determines whether or not the subsequent sheet P is different in sheet type from the preceding sheet. In this case, sheet types are considered as different sheet types if it becomes necessary to switch the operating state to another appropriate operating state after changing one sheet type to another sheet type. For example, the different sheet types may be different in thickness, size and paper material, and include a thin paper, a thick paper, a coated paper, an embossed paper or the like.

If the determination is in the negative in step 10, i.e., if the subsequent sheet P is of the same sheet type as the preceding sheet, the process proceeds to step 11 (S11). On the other hand, if the determination is in the affirmative in step 10, i.e., if the subsequent sheet P is different in sheet type from the preceding sheet, the process proceeds to step 12 (S12). Incidentally, since there is no preceding sheet just after starting a job by processing the first sheet P, the determination in step 10 is always in the negative, and therefore the process proceeds to step 11.

In step 11, the ordinary process is performed by the control unit 260 of the upstream apparatus 200 and the control unit 360 of the downstream apparatus 300. Specifically, the subsequent sheet P is conveyed with a normal sheet interval which is used when the sheet type is not changed.

On the other hand, in step 12, the control unit 260 of the upstream apparatus 200 has the subsequent sheet P stand by at the paper stop roller 252 of the upstream apparatus 200.

In step 13 (S13), after determining that a preceding sheet P is passed through the fixing unit 240 of the upstream apparatus 200 with reference to the detection result of the sheet detection sensor 253, the control unit 260 of the upstream apparatus 200 starts switching the operating state of the upstream apparatus 200 in correspondence with the sheet type of the subsequent sheet P. For example, when the sheet type of the sheet P is switched from a thick paper to a thin paper, the operating state is adjusted, for example, by lowering the fixing temperature, and decreasing the nipping pressure at the transfer nip portion and the nipping pressure at the fixing nip portion, as compared to the current values respectively.

In step 14 (S14), after determining that the preceding sheet P is passed through the fixing unit 340 of the downstream apparatus 300 with reference to the detection result of the sheet detection sensor 353, the control unit 360 of the downstream apparatus 300 starts switching the operating state of the downstream apparatus 300 in correspondence with the sheet type of the subsequent sheet P.

In step 15 (S15), the control unit 260 of the upstream apparatus 200 predicts the timing of finishing the switching of the operating state. Specifically, the control unit 260 compares the stabilization time required to stabilize the fixing temperature and the switching time required to switch the pressure contact condition, and predicts the finishing timing on the basis of the shorter time of these required times. The stabilization time of the fixing temperature is a time required to stabilize the fixing temperature to a target temperature after switching, i.e., to the fixing temperature suitable for the sheet type of the subsequent sheet P. This stabilization time can be estimated on the basis of the fixing temperatures corresponding respectively to the previous and subsequent sheet types and a temperature profile which has been obtained in advance. On the other hand, the switching time of the pressure contact condition is a time required to switch the pressure contact condition to a target condition after switching, i.e., the nipping pressure suitable for the sheet type of the subsequent sheet P. This switching time can be set up in advance by measuring beforehand the time required to switch the pressure contact condition.

In the case where each of the upstream apparatus 200 and the downstream apparatus 300 performs the switching of the operating state, the finishing timing is predicted on the basis of the latest of the stabilization times of the fixing temperature and the switching times of the pressure contact condition of the upstream apparatus 200 and the downstream apparatus 300. Usually, the downstream apparatus 300 starts switching the operating state after the upstream apparatus 200 starts, and the control response time of the fixing temperature is longer than that of the nipping pressure, so that the latest time is the stabilization time of the fixing temperature of the downstream apparatus 300.

In step 16 (S16), the control unit 260 of the upstream apparatus 200 determines whether or not a conveyance re-start timing is reached. The conveyance re-start timing is calculated on the basis of the finishing timing predicted in step 15. Specifically, the conveyance re-start timing corresponds to the timing with which the conveyance of the subsequent sheet P is re-started from the paper stop roller 252 of the upstream apparatus 200 in order to have the subsequent sheet P reach the paper stop roller 352 of the downstream apparatus 300 with the finishing timing.

If the determination is in the negative in step 16, i.e., the conveyance re-start timing is not reached yet, the process is returned to step 16. Conversely, if the determination is in the affirmative in step 16, i.e., the conveyance re-start timing is reached, the process proceeds to step 17 (S17).

In step 17, the control unit 260 of the upstream apparatus 200 rotates the paper stop roller 252 of the upstream apparatus 200 to re-start the conveyance of the subsequent sheet P.

In step 18 (S18), when the subsequent sheet P reaches the paper stop roller 352 of the downstream apparatus 300, the control unit 360 of the downstream apparatus 300 determines whether or not the switching of the operating state of the downstream apparatus 300 is in progress. If the determination is in the affirmative in step 18, i.e., the switching of the operating state of the downstream apparatus 300 is not finished yet, the process proceeds to step 19 (S19). Conversely, if the determination is in the negative in step 18, i.e., the switching of the operating state of the downstream apparatus 300 is finished, this routine returns control.

In step 19 (S19), the control unit 360 of the downstream apparatus 300 processes the subsequent sheet P as a jammed sheet. Namely, the control unit 360 of the downstream apparatus 300 stops the conveyance of the subsequent sheet P and displays the occurrence of the jam on a manipulation display.

Figure 3:
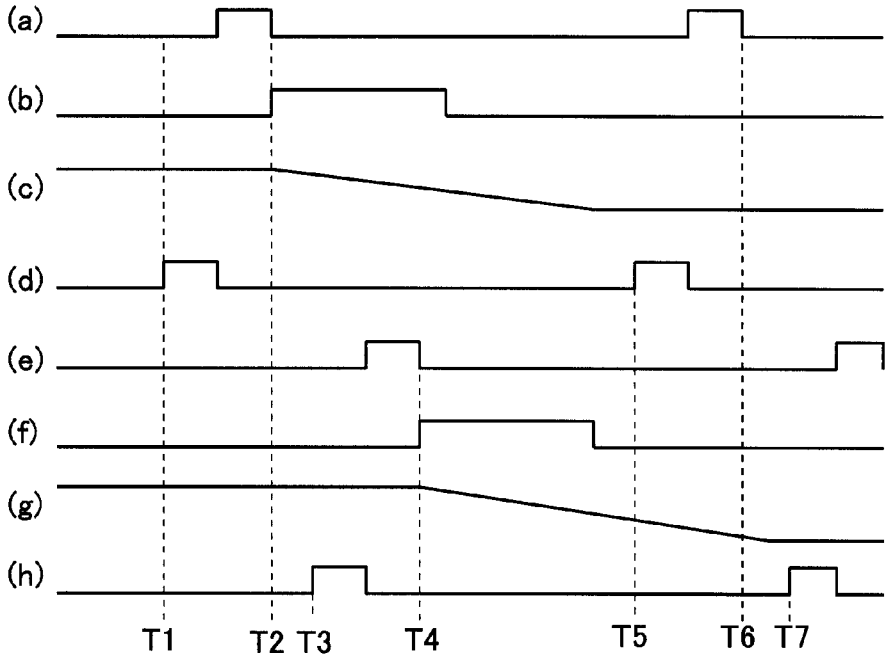
FIG. 3 is an explanatory view for showing a timing chart related to sheet conveyance in the image forming system as shown in FIG. 1.
Figure 4:
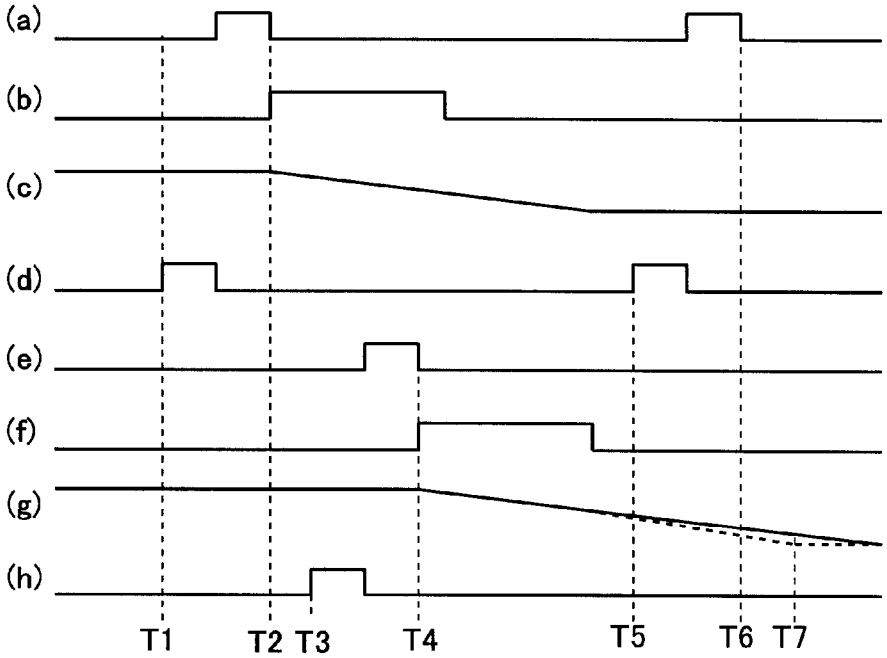
FIG. 4 is an explanatory view for showing a timing chart related to sheet conveyance in the image forming system as shown in FIG. 1.

FIG. 3 and FIG. 4 are explanatory views for showing timing charts relating to sheet conveyance. In each figure, line (a) shows the detection signal output from the sheet detection sensor 253 of the upstream apparatus 200; line (b) shows the on/off state of a drive motor for switching the nipping pressure of the upstream apparatus 200; line (c) shows the transition of the fixing temperature of the upstream apparatus 200; and line (d) shows the on/off state of a drive motor for driving the paper stop roller 252 of the upstream apparatus 200. Also, line (e) shows the detection signal output from the sheet detection sensor 353 of the downstream apparatus 300; line (f) shows the on/off state of a drive motor for switching the nipping pressure of the downstream apparatus 300; line (g) shows the transition of the fixing temperature of the downstream apparatus 300; and line (h) shows the on/off state of a drive motor for driving the paper stop roller 352 of the downstream apparatus 300. On the other hand, FIGS. 5A through 5D are explanatory views for showing the conveyance state of a sheet P with predetermined timings respectively.

Figure 5A:
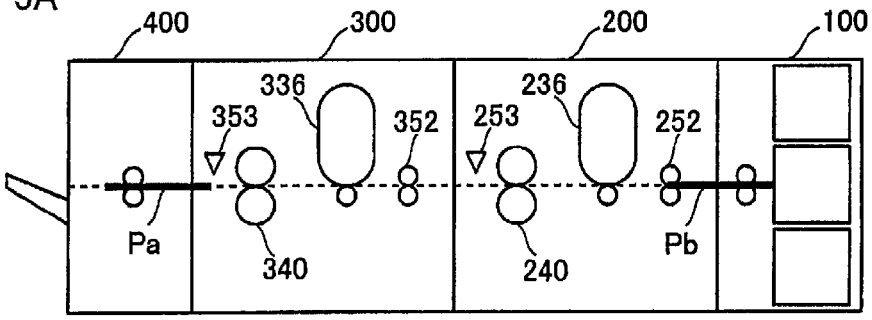
FIGS. 5A through 5D are explanatory views for showing the conveyance state of a sheet in the image forming system as shown in FIG. 1.

As shown in FIG. 3, when the drive motor of the paper stop roller 252 of the upstream apparatus 200 is turned on with timing T1, the preceding sheet P (hereinafter referred to as "sheet Pa") is sent out to the image formation process. On the other hand, if the subsequent sheet P (hereinafter referred to as "sheet Pb") is different in sheet type from the sheet Pa, this sheet Pb is made stand by at the paper stop roller 252 of the upstream apparatus 200 as shown in FIG. 5A.

When the preceding sheet P is passed through the sheet detection sensor 253 with timing T2 after the transfer process and the fixing process, the upstream apparatus 200 starts switching the operating state. In this example, the switching operation is performed by lowering the nipping pressure and the fixing temperature.

The sheet Pa discharged from the upstream apparatus 200 is supplied to the downstream apparatus 300, and sent out to the image formation process when the drive motor of the paper stop roller 352 of the downstream apparatus 300 is turned on with timing T3. When the preceding sheet Pa is passed through the sheet detection sensor 353 with timing T4 after the transfer process and the fixing process, the downstream apparatus 300 starts switching the operating state. In the downstream apparatus 300, the switching operation is performed also by lowering the nipping pressure and the fixing temperature.

Figure 5B:
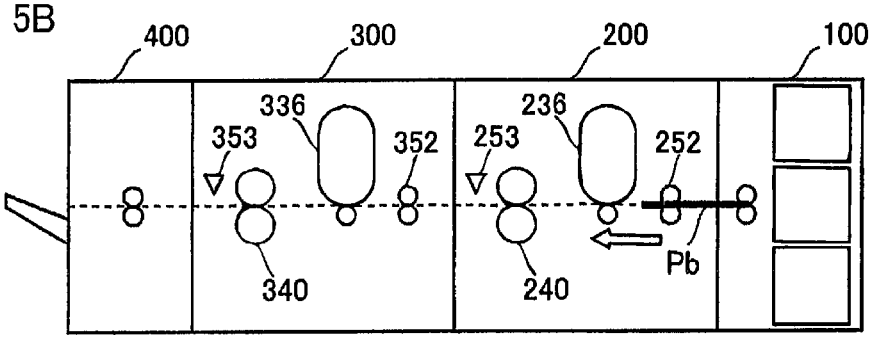

On the other hand, when the conveyance re-start timing is reached with timing T5, the drive motor of the paper stop roller 252 of the upstream apparatus 200 is turned on to send out the sheet Pb to the image formation process as shown with line (b) in FIG. 5B. After passing through the sheet detection sensor 253 with timing T6 after the transfer process and the fixing process, the sheet Pb is discharged from the upstream apparatus 200 and supplied to the downstream apparatus 300.

Then, it is determined with timing T7 corresponding to the finishing timing whether or not the switching of the operating state of the downstream apparatus 300 is in progress, i.e., whether or not the temperature is stabilized to the fixing temperature suitable for the sheet type of the subsequent sheet P. If the switching of the operating state of the downstream apparatus 300 is finished, as shown in FIG. 3, the drive motor of the paper stop roller 352 of the downstream apparatus 300 is turned on to send out the sheet Pb to the image formation process. Conversely, if the switching of the operating state of the downstream apparatus 300 is not finished yet, as shown in FIG. 4, the drive motor of the paper stop roller 352 of the downstream apparatus 300 is not turned on, and the subsequent sheet Pb is processed as a jammed sheet.

As has been discussed above, the image forming system of the present embodiment is a serial tandem image forming system which consists mainly of the upstream apparatus 200 and the downstream apparatus 300. The control unit 260 of the upstream apparatus 200 and the control unit 360 of the downstream apparatus 300 serves as the controller for controlling the operation of this image forming system. When the subsequent sheet is different in sheet type from the preceding sheet, this controller has the subsequent sheet P stand by at the paper stop roller 252 of the upstream apparatus 200, and performs the operation of switching the operating state of the upstream apparatus 200 and the operating state of the downstream apparatus 300 in accordance with the sheet type of the subsequent sheet P. On the other hand, the controller predicts the finishing timing with which the switching of the operating state is finished, and then re-starts the conveyance of the subsequent sheet, in advance of finishing the switching of the operating state, by controlling the paper stop roller 252 on the basis of the predicted finishing timing.

In accordance with this configuration, the subsequent sheet P need not be kept waiting at the paper stop roller 252 of the upstream apparatus 200 until the switching of the operating state of the downstream apparatus 300 is finished, but the conveyance of the subsequent sheet P can be re-started in advance of finishing the switching. It is therefore possible to inhibit the unnecessary extension of the waiting time of the sheet P, and prevent the productivity from reducing.

Figure 5C:
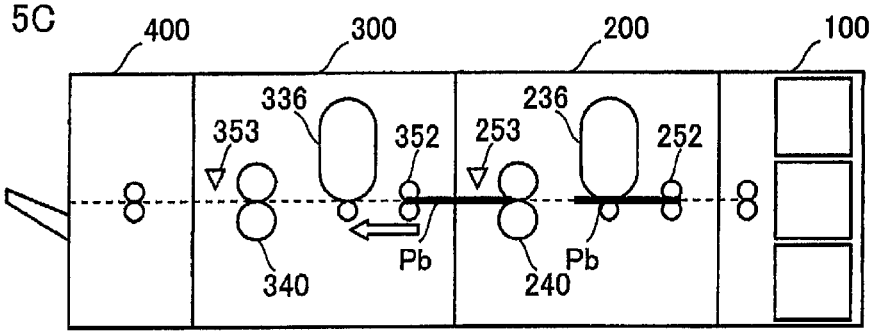
Figure 5D:
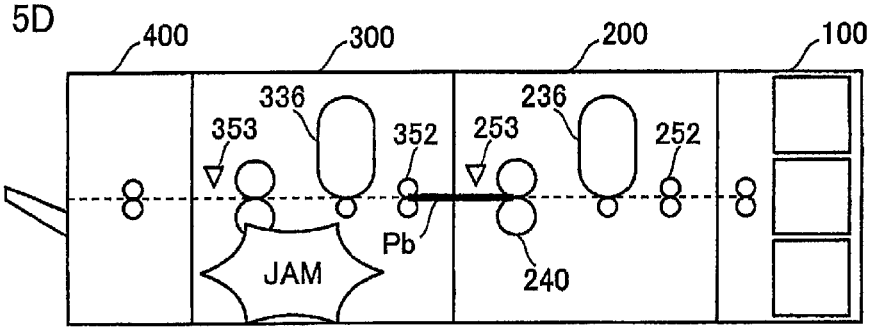

It is conceived to have the subsequent sheet Pb stand by after advancing on the paper stop roller 352 of the downstream apparatus 300 as shown in FIG. 5C. In this case, the reduction of the productivity can be avoided by re-starting the conveyance of the sheet Pb after finishing the switching of the operating state of the downstream apparatus 300 to save the conveyance time through the upstream apparatus 200. However, the subsequent sheet Pb and further subsequent sheets Pb which come after the subsequent sheet Pb may stop in the middle of the conveying route in the upstream apparatus 200. Namely, there may be a sheet which stops in the middle of the image formation process, for example, in a transfer unit or a fixing unit, and the image quality may thereby be degraded depending upon the stopping position. Particularly, while an image is to be formed also by the downstream apparatus 300 on the same sheet, it is undesirable that such a situation occurs in the upstream apparatus 200.

However, in accordance with the configuration of the present embodiment, the sheet P is made stand by in a preceding stage of the image formation process in the upstream apparatus 200. It is therefore possible to inhibit the undesirable situation that a sheet P stops in the middle of the image formation process, and prevent the quality of images from being degraded. On the other hand, in the case of such a serial tandem image forming system, the conveyance distance corresponds to the length through two apparatuses, i.e., the upstream apparatus 200 and the downstream apparatus 300. If the sheet Pb stood by in the upstream apparatus 200, the sheet Pb would have to travel a longer conveyance distance before being discharged from the downstream apparatus 300, resulting in the reduction of the productivity. However, as has been discussed above, the subsequent sheet P need not be kept waiting until the switching of the operating state of the downstream apparatus 300 is finished, but the conveyance of the subsequent sheet P can be re-started in advance of finishing the switching. It is therefore possible to inhibit both the degradation of image quality and the reduction of the productivity.

Also, when the subsequent sheet P is supplied to the downstream apparatus 300 after re-starting the conveyance, the controller of the image forming system of the present embodiment determines whether or not the switching of the operating state of the downstream apparatus 300 has been finished, and processes the subsequent sheet P as a jammed sheet if it is determined that the switching of the operating state of the downstream apparatus 300 has not been finished yet.

The timing of finishing the switching of the operating state can be predicted with reference to the temperature profile or the like, but sometimes differs from the prediction due to an aging process and/or some other factor. In this case, even if the the conveyance of a sheet P is re-started beforehand, this conveyance can be halted, if necessary, by processing the sheet P as a jam sheet.

Incidentally, when the subsequent sheet P is processed as a jam sheet, it is preferred that the controller of the image forming system adds a predetermined margin to the predicted finishing timing for a sheet which comes after the subsequent sheet. When the operating state is switched again, it is therefore possible to inhibit the conveyance of a sheet P from being re-started too early.

Also, when a sheet P reaches the paper stop roller 352 of the downstream apparatus 300, the controller of the image forming system of the present embodiment determines whether or not the switching of the operating state has been finished.

In accordance with this configuration, it is possible to determine, just before the image formation process of a sheet P in the downstream apparatus 300, whether or not the switching of the operating state has been finished. The reduction of the productivity can therefore be inhibited by performing the determination of whether to process the sheet P as a jam sheet in a position in the downstream side as late as possible.

Also, in accordance with the present embodiment, the upstream apparatus 200 and the downstream apparatus 300 are capable of switching, as its operating state, the fixing temperature and the pressure contact condition of the nip portion. The controller of the image forming system then compares the stabilization time of the fixing temperature and the switching time of the pressure contact condition, and predicts the finishing timing on the basis of the later of them.

In accordance with this configuration, it is possible to appropriately predict the finishing timing with which the switching of the operating state is finished.

Also, the controller of the image forming system of the present embodiment predicts the finishing timing on the basis of the latest time of the stabilization and switching times of the upstream apparatus 200 and the downstream apparatus 300.

In accordance with this configuration, it is possible to appropriately predict the finishing timing with which the switching of the operating state is finished.

Also, the controller of the image forming system of the present embodiment sets up the stabilization time on the basis of the target temperatures before and after switching and a predetermined temperature profile. Furthermore, the controller of the image forming system of the present embodiment sets up the switching time by measuring beforehand the time required to switch the pressure contact condition.

In accordance with this configuration, it is possible to appropriately predict the finishing timing with which the switching of the operating state is finished.

The foregoing description has been presented on the basis of the image forming system according to the embodiments of the present invention. However, it is not intended to limit the present invention to the precise form described, and obviously many modifications and variations are possible within the scope of the invention. For example, an image forming apparatus based on another printing technique than the electrophotography can be used as the upstream apparatus and/or the downstream apparatus of a tandem image forming system according to the present invention.

Also, the upstream apparatus and the downstream apparatus can be connected in series with an intervening relay apparatus which can reverse the front and back sides of a sheet received from the upstream apparatus and transfer the sheet to the downstream apparatus for performing a serial double-side printing process. In the case where such a relay device is installed in the image forming system, the upstream apparatus and the downstream apparatus are not necessarily provided with the functionality of reversing a sheet. Furthermore, the structures of the upstream apparatus and the downstream apparatus need not be identical in a strict sense, but it is only necessary to perform a single-machine double-side printing process respectively.

On the other hand, in the case of the embodiment as described above, the control unit of the upstream apparatus and the control unit of the downstream apparatus serve as the controller of the image forming system. However, the functionality of integrally controlling the operation of the image forming system may be implemented within either of the control units of the upstream and downstream apparatuses. Alternatively, a dedicated control device may be separately installed for this functionality. Furthermore, the present invention can be considered to relate not only to the image forming system, but also to this method of controlling the image forming system.

What is claimed is:

1. A serial tandem image forming system comprising:

a first image forming apparatus configured to form an image on a sheet;

a second image forming apparatus connected to the first image forming apparatus in series and configured to form an image on the sheet which is supplied from the first image forming apparatus; and a controller configured to control the first image forming apparatus and the second image forming apparatus respectively, wherein each of the first image forming apparatus and the second image forming apparatus is provided with a registration unit which sends out a sheet to an image formation process, wherein when a preceding sheet and a subsequent sheet coming just after the preceding sheet differ in sheet type, the controller performs an operation of switching an operating state of the first image forming apparatus and the second image forming apparatus in accordance with the sheet type of the subsequent sheet while having the subsequent sheet stand by at the registration unit, and wherein the controller predicts a finishing timing at which the switching of the operating state is finished, and then re-starts conveyance of the subsequent sheet, in advance of finishing the switching of the operating state, by controlling the registration unit based on the predicted finishing timing.

2. The image forming system of claim 1, wherein when the subsequent sheet is supplied to the second image forming apparatus after re-starting the conveyance, the controller determines whether or not the switching of the operating state of the second image forming apparatus has been finished, and processes the subsequent sheet as a jammed sheet if it is determined that the switching of the operating state of the second image forming apparatus has not been finished yet.

3. The image forming system of claim 2, wherein when the subsequent sheet is processed as a jammed sheet, the controller adds a predetermined margin to the predicted finishing timing for a sheet which comes after the subsequent sheet.

4. The image forming system of claim 2, wherein when a sheet reaches the registration unit of the second image forming apparatus, the controller determines whether or not the switching of the operating state has been finished.

5. The image forming system of claim 1, wherein the first image forming apparatus and the second image forming apparatus are capable of switching, as the operating state, a fixing temperature and a pressure contact condition of a nip portion, and wherein the controller compares a stabilization time, which is required to stabilize the fixing temperature to a target temperature after switching, with a switching time of the pressure contact condition of the nip portion to a target condition after switching, and predicts the finishing timing based on the later of the stabilization time and the switching time.

6. The image forming system of claim 5, wherein the controller predicts the finishing timing based on the latest time of the stabilization and switching times of the first image forming apparatus and the second image forming apparatus.

7. The image forming system of claim 5, wherein the controller sets up the stabilization time based on target temperatures before and after switching and a predetermined temperature profile.

8. The image forming system of claim 5, wherein the controller sets up the switching time by measuring beforehand the time required to switch the pressure contact condition.

9. The image forming system of claim 1, wherein the controller predicts the finishing timing at which the switching of the operating state of the second image forming apparatus is finished, and then re-starts the conveyance of the subsequent sheet, in advance of finishing the switching of the operating state of the second image forming apparatus, by controlling the registration unit based on of the predicted finishing timing.

10. The image forming system of claim 1, wherein the first image forming apparatus and the second image forming apparatus are capable of switching a fixing temperature as the operating state, and wherein the controller predicts the finishing timing based on a stabilization time which is required to stabilize the fixing temperature to a target temperature after switching.

11. A control method of an image forming system which includes a first image forming apparatus configured to form an image on a sheet, and a second image forming apparatus connected to the first image forming apparatus in series and configured to form an image on the sheet which is supplied from the first image forming apparatus, said control method comprising:

a first step of determining whether or not a preceding sheet and a subsequent sheet coming just after the preceding sheet differ in sheet type;

a second step of having the subsequent sheet stand by at a registration unit of the first image forming apparatus when it is determined that the preceding sheet differs from the subsequent sheet in sheet type;

a third step of starting switching an operating state of the first image forming apparatus and an operating state of the second image forming apparatus respectively in accordance with the sheet type of the subsequent sheet;

a fourth step of predicting a finishing timing of finishing the switching of the operating state; and a fifth step of controlling the registration unit based on the predicted finishing timing to re-start conveyance of the subsequent sheet, in advance of finishing the switching of the operating state.

12. The control method of claim 11, further comprising:

a sixth step of determining, when the subsequent sheet is supplied to the second image forming apparatus after re-starting the conveyance, whether or not the switching of the operating state of the second image forming apparatus has been finished; and a seventh step of processing the subsequent sheet as a jammed sheet if it is determined that the switching of the operating state of the second image forming apparatus has not been finished yet.

13. The control method of claim 12, wherein when the subsequent sheet is processed as a jammed sheet in the seventh step, a predetermined margin is added to the predicted finishing timing for a sheet which comes after the subsequent sheet in the fourth step.

14. The control method of claim 12, wherein in the sixth step, when a sheet reaches the registration unit of the second image forming apparatus, it is determined whether or not the switching of the operating state has been finished.

15. The control method of claim 11, wherein the first image forming apparatus and the second image forming apparatus are capable of switching, as the operating state, a fixing temperature and a pressure contact condition of a nip portion, and wherein in the fourth step, a stabilization time required to stabilize the fixing temperature to a target temperature after switching is compared with a switching time of the pressure contact condition of the nip portion to a target condition after switching, and the finishing timing is predicted based on the later of the stabilization time and the switching time.

16. The control method of claim 15, wherein in the fourth step, the finishing timing is predicted based on the latest time of the stabilization and switching times of the first image forming apparatus and the second image forming apparatus.

17. The control method of claim 15, wherein in the fourth step, the stabilization time is set up based on target temperatures before and after switching and a predetermined temperature profile.

18. The control method of claim 15, wherein in the fourth step, the switching time is set up by measuring beforehand the time required to switch the pressure contact condition.

19. The control method of claim 11, wherein in the fourth step, the finishing timing of finishing the switching of the operating state of the second image forming apparatus is predicted, and wherein in the fifth step, the registration unit is controlled based on the predicted finishing timing to re-start the conveyance of the subsequent sheet in advance of finishing the switching of the operating state of the second image forming apparatus.

20. The control method of claim 11, wherein in the third step, switching a fixing temperature of each of the first image forming apparatus and the second image forming apparatus is started in accordance with the sheet type of the subsequent sheet, and wherein in the fourth step, the finishing timing is predicted based on a stabilization time which is required to stabilize the fixing temperature to a target temperature after switching.

* * * * *